US007250565B2

(12) United States Patent
Hermanson et al.

(10) Patent No.: US 7,250,565 B2
(45) Date of Patent: Jul. 31, 2007

(54) AUTOMATED MUSICAL INSTRUMENT

(75) Inventors: Terry Hermanson, New York, NY (US); Huang Meng-Suen, Hong Kong (HK)

(73) Assignee: Mr. Christmas Inc., New York, NY (US)

( * ) Notice: Subject to any disclaimer, the term of this patent is extended or adjusted under 35 U.S.C. 154(b) by 119 days.

(21) Appl. No.: 11/156,624

(22) Filed: Jun. 21, 2005

(65) Prior Publication Data

US 2006/0283305 A1 Dec. 21, 2006

(51) Int. Cl.
*G10F 1/06* (2006.01)

(52) U.S. Cl. ..... 84/94.1

(58) Field of Classification Search ..... 84/94.1–100, 84/2, 3, 600

See application file for complete search history.

(56) References Cited

U.S. PATENT DOCUMENTS 5,498,833 A * 3/1996 Huang ..... 84/94.1
5,521,321 A * 5/1996 Liu ..... 84/95.1
6,291,749 B1 * 9/2001 Tseng ..... 84/95.2
6,960,710 B2 * 11/2005 Segan et al. ..... 84/94.1
7,034,215 B2 * 4/2006 Kaneko et al. ..... 84/98
2004/0231486 A1 * 11/2004 Segan et al. ..... 84/94.1

* cited by examiner

*Primary Examiner*—Ross Gushi
(74) *Attorney, Agent, or Firm*—Fitzpatrick, Cella, Harper & Scinto

(57) ABSTRACT

An automated musical instrument includes at least one tine, circuitry, a switch, and a trigger. The tine produces a first audible sound when vibrated. The circuitry produces a second audible sound when activated. The switch is connected to the circuitry and is operable when actuated to activate the circuitry. The trigger is selectably operable substantially simultaneously (a) to vibrate the tine to produce the first audible sound and (b) to actuate the switch in turn to activate the circuitry to produce the second audible sound.

24 Claims, 3 Drawing Sheets

AUTOMATED MUSICAL INSTRUMENT

BACKGROUND OF THE INVENTION

1. Field of the Invention

This invention generally relates to automated musical instruments. More particularly, this invention relates to an improved method and device for playing music in an automated musical instrument.

2. Description of the Related Art

While the preferred use of this invention is with a music box, and portions of the following discussion of the invention are made relative to a music box, the invention is not limited to music boxes. Music boxes, player pianos, and the like, are all known types of automated musical instruments, and features of the invention are suitable for application in numerous automated musical instruments. Accordingly, the use of the term music box is exemplary only, and in no way limiting.

Automated musical instruments, and in particular music boxes, are commonly known to be collectibles, heirlooms, conversation pieces, and decorations. The distinctive sound produced by music boxes is a result of reeds, or tines, being vibrated. In particular, in these instruments plural tines of varying length and width, each producing a different musical note or sound, are vibrated in an arranged sequence to create a melody. Conventionally, at least three types of automated musical instruments are known, which use three different methods to vibrate the tines.

The first of these methods utilizes a rotatable drum disposed proximate to the plurality of tines. U.S. Pat. No. 6,329,580 is an example of a drum-type music box that uses this first method. In the '580 patent, a drum having prongs protruding therefrom is constantly rotated about an axis. As the drum rotates, the prongs contact the various tines of a musical tine member, causing the contacted tines to be picked and thus to vibrate. As each tine vibrates, a different musical note is produced. By providing the prongs in different arrangements on the drum, various melodies can be produced by picking the tines in the order of the notes of a melody.

A second method of vibrating tines in an automated musical instrument to create a melody uses a disc having protrusions formed thereon. U.S. Pat. No. 5,973,240 relates to a disc-type music box that uses this second method. As discussed in the '240 patent, projections are formed in a pattern on a horizontally-oriented disc. As the disc rotates, the projections contact and vibrate vertically disposed tines, creating a desired melody. Alternatively, the projections may cause rotation of vertically disposed pin wheels, with each of the pin wheels corresponding to a tine of a horizontally disposed comb. When the pin wheels are rotated, a pin portion thereof contacts and vibrates the corresponding tine, creating a musical note.

A third method used to create music in automated musical instruments is described in U.S. Pat. No. 5,698,801, which is assigned to the assignee of the present application. The automated musical instrument utilizes a tape having a plurality of holes therethrough. The tape is fed over a plurality of discs, each having projections depending radially outwardly therefrom. During this movement of the tape, the projections on the discs are caught in the tape's holes, causing the discs to rotate. The rotation of the disc causes one of the projections on the disc to engage a corresponding tine. The projections move the tines and subsequently disengage, allowing the tines to spring back to their original position. The thus-caused vibration of the tines generates an audible sound.

While each of the above-discussed patents discusses a different type of automated musical instrument in which sound is generated using the vibration of plural tines, none of those patents contemplates making an electrically generated sound in conjunction with the tine-created sound.

Accordingly, a further improved automated musical instrument is desired that has the traditional musical sound of conventional automated musical instruments, but that also includes an additional, electronically-produced sound.

SUMMARY OF THE INVENTION

The present invention addresses the problems of conventional automated musical devices discussed above.

According to a first aspect of the present invention, an automated musical instrument includes at least one tine, circuitry, a switch, and a trigger. The tine produces a first audible sound when vibrated. The circuitry produces a second audible sound when activated. The switch is connected to the circuitry and is operable when actuated to activate the circuitry. The trigger is selectably operable (a) to vibrate the tine to produce the first audible sound and (b) to actuate the switch in turn to activate the circuitry to produce the second audible sound in synchronism with vibration of the tine. The trigger may be operable to vibrate the tine and trip the switch substantially simultaneously. In this way a unique and pleasant combination of types of coordinated sounds, one type mechanical and one type electronic, may be produced in a way not previously believed to have been known.

According to another aspect of the present invention, an automated musical instrument includes a plurality of tines, circuitry, a plurality of switches, and a plurality of triggers. Each of the plurality of tines has an associated cantilevered end and is configured to produce a different one of a plurality of first audible sounds when its associated cantilevered end is plucked. The circuitry produces a plurality of different second audible sounds. Each of the plurality of switches includes an associated switch lever that when tripped actuates the associated switch means. Each of the switch means is connected to activate the circuitry to produce a different one of the plurality of the second audible sounds when the associated switch lever is tripped. Each of the plurality of triggers is associated with one of the plurality of tines and one of the plurality of switches. The plurality of triggers are selectably operable substantially simultaneously (a) to pluck the cantilevered end of the associated one of the tines and (b) to trip the switch lever of the associated one of the switches, thereby substantially simultaneously to produce one of the plurality of first audible sounds and one of the plurality of second audible sounds. The triggers are selectably operated to produce a pattern of first audible sounds and second audible sounds.

A better understanding of these and other aspects, features, and advantages of the invention may be had by reference to the drawings and to the accompanying description, in which preferred embodiments of the invention are illustrated and described.

BRIEF DESCRIPTION OF THE DRAWINGS

Throughout the figures, like or corresponding reference numerals are used to identify like or corresponding parts.

DETAILED DESCRIPTION OF THE PREFERRED EMBODIMENTS

A preferred embodiment of this invention will be discussed with reference to FIGS. 1 and 2. Specifically, those figures depict a music module 2 including a plurality of rotors, a vibration plate, a plurality of electrical switches, and a control module. The music module 2 is preferably for use in an automated musical instrument, such as a music box, player piano, or the like. As is known, the music module may be contained in a decorative or ornamental case or housing to provide an aesthetically pleasing display.

Figure 1:
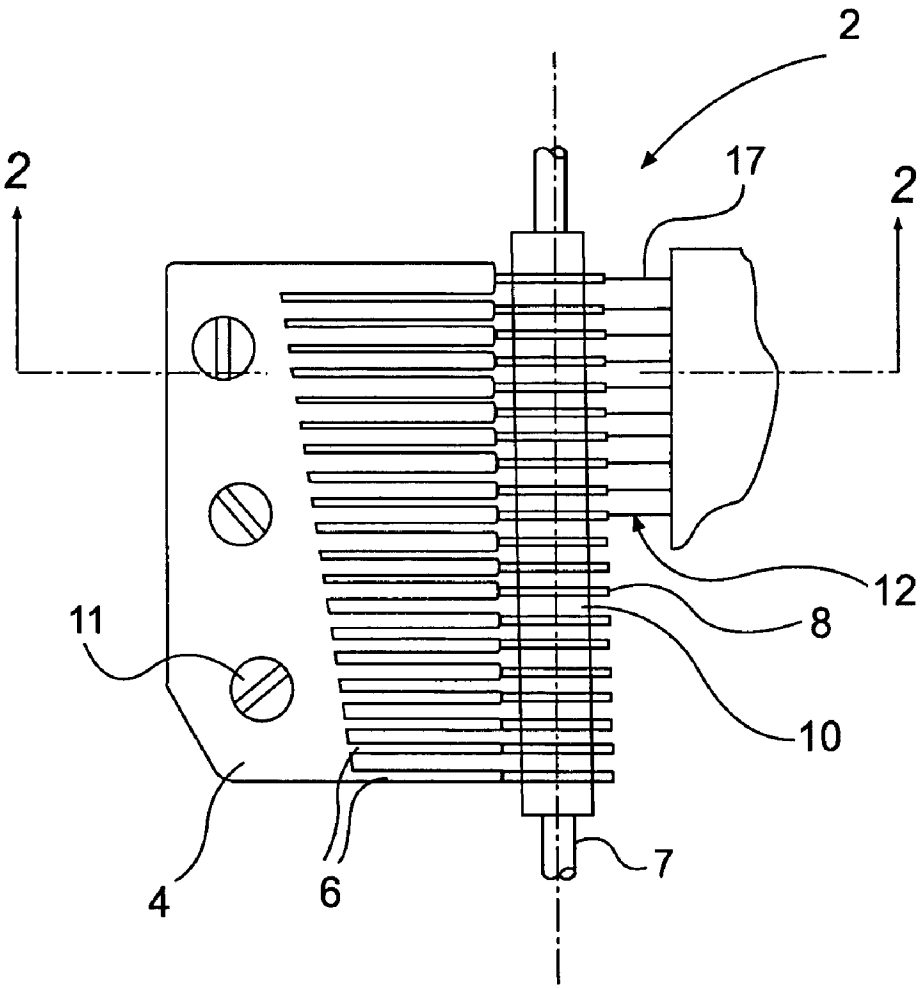
FIG. 1 is a top plan view of a music module for use in an automated musical instrument according to an embodiment of the invention.

The vibration plate 4 is formed with a plurality of tines 6, each cantilevered and of a different increasing length and/or thickness from bottom to top as seen in FIG. 1. When plucked, i.e., struck on the cantilevered end, each of the tines 6 vibrates to produce a different note or sound.

Figure 2:
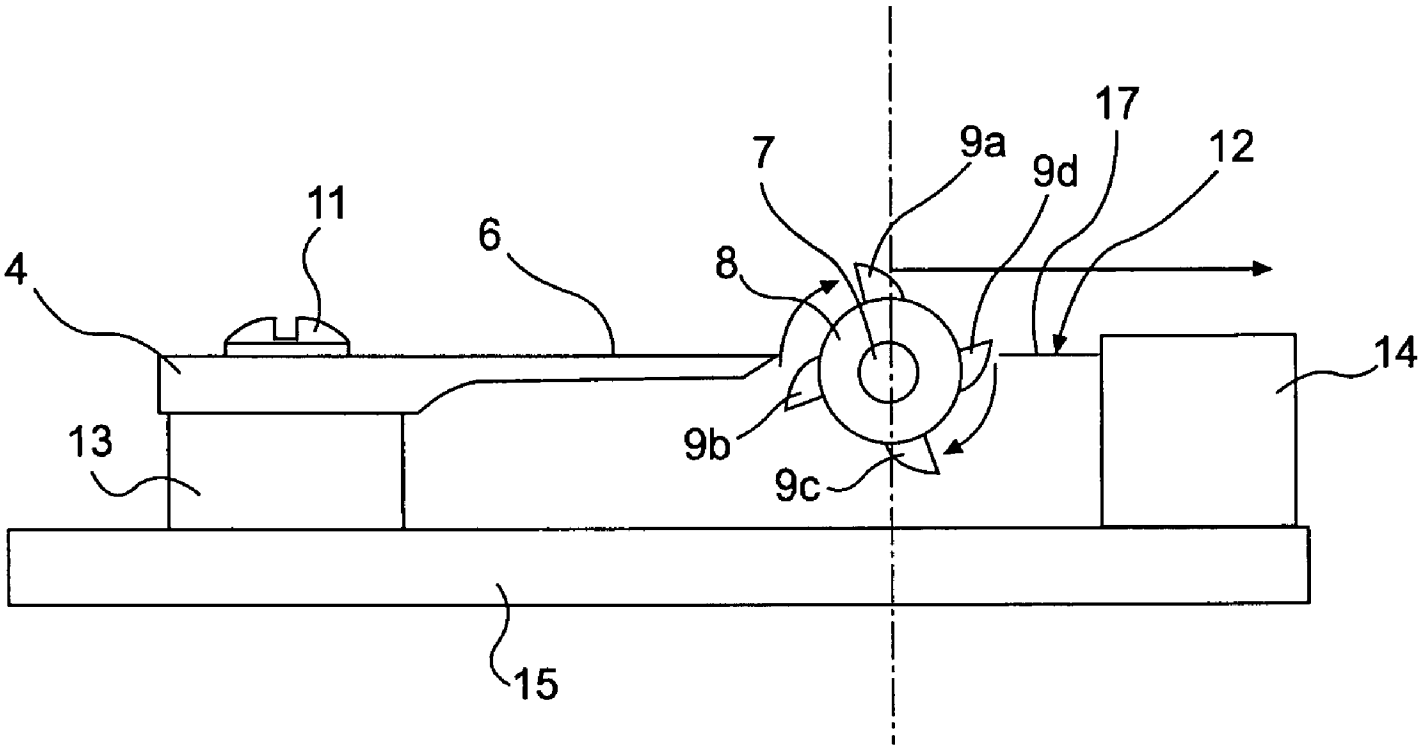
FIG. 2 is a vertical cross-sectional view of the music module shown in FIG. 1 taken along plane 2—2.

As best seen in FIG. 2, each of the rotors 8 has a plurality of picks 9*a*–9*d* protruding radially outwardly from its periphery. As illustrated, first through fourth picks 9*a*–9*d* are substantially saw-toothed in cross-section and are disposed at equivalent intervals about the circumference of each of the rotors 8. Preferably, all of the rotors 8 are disposed for rotation about a single shaft 7, and the flat edge of the picks is a trailing edge with regard to the rotational direction of the rotors 8. Spacers 10 also may be provided on the shaft to separate adjacent rotors.

As noted above, the vibration plate 4 includes plural tines 6. Preferably, each of the tines 6 is disposed on the vibration plate 4 so that its terminal end is fixed and its opposite, distal end is free to vibrate. For example the plate 4 may be secured by screws 11 to a block 13 that is, in turn, mounted on a base 15. The vibration plate 4 of this construction is generally comb-shaped. Furthermore, each of the tines 6 preferably has a different length and/or thickness, which causes each to emit a different sound or note when vibrated. The free end of each of the tines 6 may be tapered, to more readily facilitate displacement of the tines 6.

Each of the plurality of electrical switches 12, which may be limit switches, is mounted with a control module 14. Each switch includes a switch lever 17 that when tripped closes or opens electrical contacts (not shown) to produce a signal to the control module 14. Each electric signal is processed in the control module 14, which includes sound producing circuitry as is known, thereby to cause an audible sound corresponding to the tripped switch lever to be produced by the sound producing circuitry. The control module 14 preferably includes the sound producing circuitry and other control circuitry in the form of an integrated circuit or the like. As will be discussed in more detail below, a number of switches 12 preferably are provided corresponding to the number of tines 6.

In a preferred arrangement, the vibration plate 4 is disposed proximate to the rotors 8. For example, the preferred vibration plate 4 depicted in FIG. 1 includes twenty tines 6 of differing length and/or thickness, and twenty rotors 8, one corresponding to each of the tines 6, are disposed such that the picks 9*a*–9*d* of the rotors 8 may sequentially contact the tines 6 when the rotors 8 are rotated. The spacers 10 are arranged between the rotors 8 to ensure that the picks 9*a*–9*d* of the rotors 8 properly align with the tines 6.

Similarly twenty switches 12, with one of the switches 12 corresponding to each of the rotors 8 and its corresponding tine also are provided. The switch lever 17 of each of the switches is also disposed in the path of the picks 9*a*–9*d* of one rotor 8 to which the switch corresponds. As can be seen in FIG. 2 the tines and switch levers are positioned so that when on pick 9*b* plucks one tine 6 an opposing pick 9*d* simultaneously trips a corresponding switch lever 17. In the preferred embodiment, for example as shown in FIG. 2, each rotor comprises the equidistantly spaced first through fourth picks 9*a*–9*d*, and associated tines and switch levers are disposed proximate to the rotor 8, substantially 180 degrees one from the other. Of course simultaneous plucking of a tine and tripping of a switch lever may be achieved with rotor configurations having more or less than four picks by mounting the tines and switches at appropriate locations relative to the rotors.

Music is made by the music module 2 having the foregoing arrangement when one or more of the rotors is rotated. Specifically, when one of the rotors 8 is displaced rotationally, all of the picks 9*a*–9*d* on that rotor also are displaced rotationally. Thus, when a first pick 9*a* is caused to rotate, a second pick 9*b* will pluck an associated tine 6 and a fourth pick 9*d* will trip an associated switch lever 17. Therefore, as discussed above, plucking of the tine results in vibration of that tine, and thus production of a musical note. Tripping of the corresponding switch lever results in actuation of the associated switch, and thus a signal is sent to the control module with instructions to cause the sound producing circuitry simultaneously to emit an audible sound.

As illustrated and described, the rotors 8, tines 6, and switches 12 are arranged such that the tines are plucked substantially simultaneously with tripping of the associated switch lever. In this manner, the mechanical musical note is created by the tine substantially in unison with production of the audible electronic sound. Of course, the rotors, tines, and electrical switches also may be arranged such that the musical note and the audible sound are created at different but preferably synchronized times, i.e., by causing the tine to be plucked and the switch to be actuated either before or after the associated tine is plucked.

As should be evident from the foregoing, when multiple rotors 8, tines 6, and switches 12 are provided, the rotors 8 may be selectively rotated to create an array of combinations of musical notes and audible sounds. Through appropriate triggering of the tines and switches, any number of songs may be played, utilizing any combination of the notes and audible sounds created by the tines and sound producing circuitry.

To control displacement of the rotors 8, and thus trigger the tines 6 and switches 12, any number of structures may be employed. For example, a film having holes therethrough arranged in a particular pattern may be passed over the rotors. In such an arrangement, each of the holes is registrable with one of the picks of an associated rotor, and as the film is passed over the rotors, the hole engages the pick, driving the associated rotor. Thus, using the example of FIG. 2, as the film is passed above and adjacent to the illustrated one of the rotors 8, one of the holes registers with the first pick 9*a*. Continued movement of the film substantially tangentially to the rotor results in the displacement of the first pick 9*a*, and rotation of the rotor 8. As discussed above, such rotation results in the second pick 9*b* plucking the tine and the fourth pick 9*d* triggering the switch lever 12.

Figure 3:
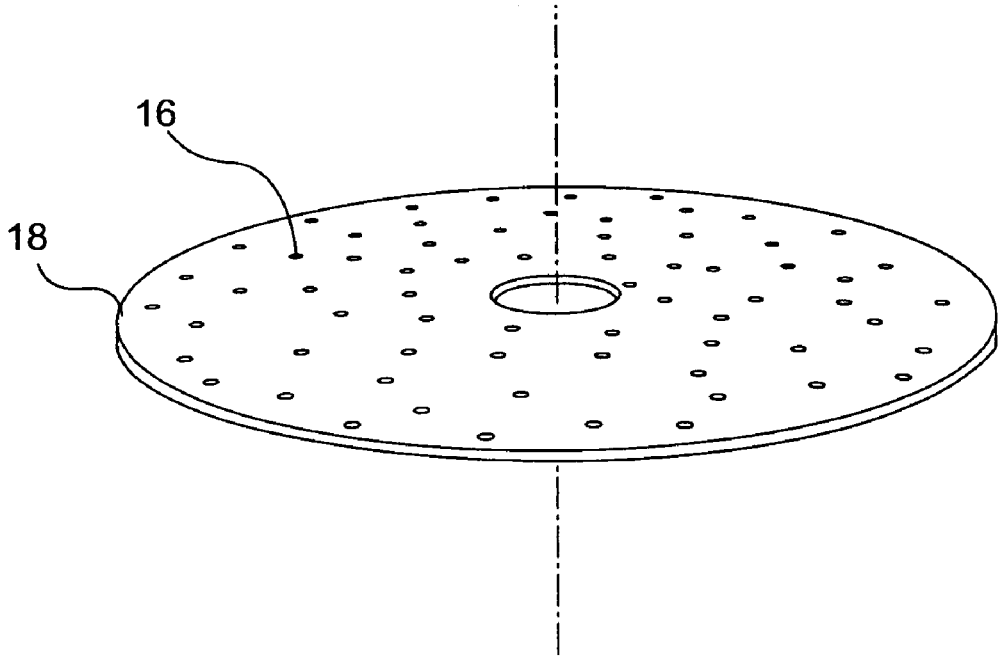
FIG. 3 is a perspective view of a film that may be used with the music module of the present invention.
Figure 4:
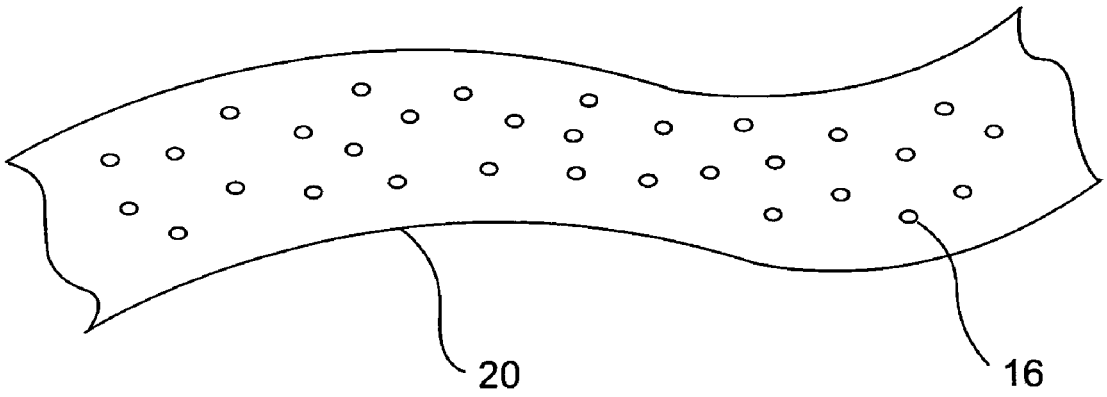
FIG. 4 is a perspective view of a film that may be used with the music module of the present invention.

As depicted in FIG. 3, the film may be embodied in a disc 18 mounted for rotation about a central axis relative to the rotors. The holes 16 are arranged on a radius of the disc 18. Alternatively, the film may be embodied as a tape 20, as shown in FIG. 4. The tape 18 is mounted for translation relative to the rotors, with the holes 16 arranged transverse to the axis of movement of the tape 20. Still other mechanisms may be provided to drive the rotors in the designed sequence or pattern. For example, copending Provisional U.S. Patent Application No. 60/647,388, filed Jan. 28, 2005 and owned commonly with the subject application, discloses one such alternative mechanism. The noted application is incorporated in its entirely herein by reference While the present invention has been described in terms of the preferred embodiments depicted in the Figures, several variations are also envisioned, and are thus within the scope of the invention.

For instance, the number of tines 6 may be varied from the twenty depicted in the figures. More tines may be desired for an automated musical instrument that plays more complex musical works having many notes. Conversely, for a more simplistic automated musical device that plays only simple melodies, less tines may be necessary.

As noted, the number of picks formed on each of the rotors also may be varied, depending upon design preference. However, it is preferred that at least two picks are provided on each of the rotors, i.e., one to contact a tine, and one to contact a switch level at least, about the same time.

Furthermore, while the picks on the rotors are embodied as saw-toothed in cross-section, such is not required. In fact, any cross-section of the picks that allows the picks to cause vibration of the tine and to actuate the switch lever, and that allows for the picks to be engaged for imparting rotation on the rotor will suffice.

In addition, while the tines are shown in the figures as all being an integral part of the vibration plate, each of the tines may be an individual piece, fastened to the vibration plate using conventional means. In this manner, if a tine were to break or otherwise not function properly, that specific tine could be removed and replaced. Alternatively, when all of the tines are integrally formed with the vibration plate, if a tine breaks, the entire vibration plate must be replaced.

One of ordinary skill in the art will realize that these and other modifications and variations are possible within the spirit and scope of the present invention. The invention is intended to be limited in scope only by the accompanying claims, which should be accorded the broadest interpretation so as to encompass all such modifications, equivalent structures and functions.

The invention claimed is:

1. An automated sound producing instrument, comprising:

at least one tine configured for producing a first audible sound when vibrated;

circuit means for producing a second audible sound when activated;

switch means connected to said circuit means and being operable when actuated to activate said circuit means; and trigger means selectably operable (a) to vibrate said tine to produce the first audible sound and (b) to actuate said switch means to activate said circuit means to produce the second audible sound in synchronism with vibration of said tine.

2. The automated sound producing instrument according to claim 1, wherein said tine has a cantilevered end that when plucked causes said tine to vibrate, and wherein said trigger means is configured selectably to pluck said cantilevered end of said tine.

3. The automated sound producing instrument according to claim 1, wherein said switch means includes a switch lever that when tripped actuates said switch means, and wherein said trigger means is configured selectably to trip said switch lever.

4. The automated sound producing instrument according to claim 1, wherein at least one of said first audible sound and said second audible sound is a musical note.

5. The automated sound producing instrument according to claim 1, wherein said trigger means is operable substantially simultaneously (a) to vibrate said tine and (b) to actuate said switch means.

6. The automated sound producing instrument according to claim 1, wherein said tine has a cantilevered end that when plucked causes said tine to vibrate;

wherein said switch means includes a switch lever that when tripped actuates said switch means; and wherein said trigger means is configured substantially simultaneously (a) to pluck said cantilevered end of said tine and (b) to trip said switch lever.

7. The automated sound producing instrument according to claim 6, wherein said trigger means comprises a rotor having at least two radially extending picks each configured to pluck said cantilevered end of said tine and to trip said switch lever, and further configured such that when one said pick plucks said cantilevered end of said tine, a second said pick substantially simultaneously trips said switch lever.

8. The automated sound producing instrument according to claim 7, wherein said trigger means further comprises means for selectably driving said rotor to drive said one pick to pluck said cantilevered end of said tine and said second pick to trip said switch lever.

9. An automated musical instrument, comprising:

a plurality of tines each having an associated cantilevered end and each configured to produce a different one of a plurality of first audible sounds when its associated cantilevered end is plucked;

circuit means for producing a plurality of different second audible sounds;

a plurality of switch means each comprising an associated switch lever that when tripped actuates the associated switch means, each said switch means being connected to activate said circuit means to produce a different one of the plurality of said second audible sounds when said associated switch lever is tripped;

a plurality of trigger means each associated with one of said plurality of tines and one of said plurality of switch means, and being selectably operable (a) to pluck said cantilevered end of the associated one of said tines and (b) to trip said switch lever of the associated one of said switch means in synchronism with plucking of said associated one of said tines, thereby to produce one of the plurality of first audible sounds and one of the plurality of second audible sounds in synchronism; and means for selectably operating said plurality of trigger means to produce a pattern of first audible sounds and second audible sounds.

10. The automated musical instrument according to claim 9, wherein each of said trigger means is selectably operable substantially simultaneously (a) to pluck the cantilevered end of the associated tine one of said tines and (b) to trip said lever of the associated one of said switch means.

11. The automated musical instrument according to claim 9, wherein each said trigger means comprises a rotor having at least two radially extending picks each configured (a) to pluck the cantilevered end of the associated tine and (b) to trip the associated switch lever, and further configured such that when one said pick plucks said cantilevered end of the associated tine, a second pick substantially simultaneously trips the switch lever of the associated switch means.

12. The automated musical instrument according to claim 11, wherein each said rotor has at least four radially extending picks positioned equidistantly about the circumference of the rotor.

13. The automated musical instrument according to claim 11, wherein said selectably operable means comprises means for selectably driving said rotor of each said trigger means.

14. The automated musical instrument according to claim 13, where said driving means comprises a film having holes therein registerable with said picks of the associated rotor, and means for moving said film to cause the hole to engage a pick and drive said associated rotor.

15. The automated musical instrument according to claim 14, wherein said film is in the form of a dismounted for rotation about an axis relative to the associated rotor and wherein the hole is arranged on a radius of said disc.

16. The automated musical instrument according to claim 14, wherein said film is in the form of a tape mounted for translation relative to the associated rotor, and wherein the hole is arranged transverse to a major axis of said tape.

17. An automated sound producing instrument, comprising:

at least one tine configured for producing a first audible sound when vibrated;

circuit means for producing a second audible sound when activated;

a switch connected to said circuit means and being operable when closed to activate said circuit means; and an actuating device selectably operable (a) to vibrate said tine to produce the first audible sound and (b) to close said switch means to activate said circuit means to produce the second audible sound in synchronism with vibration of said tine.

18. The automated sound producing instrument according to claim 17, wherein said tine has a cantilevered end that when plucked causes said tine to vibrate, and wherein said actuating device is configured selectably to pluck said cantilevered end of said tine.

19. The automated sound producing instrument according to claim 17, wherein said switch includes a switch lever that when operated to close actuates said switch, and wherein said actuating device is configured selectably to operate said switch lever to close.

20. The automated sound producing instrument according to claim 17, wherein said tine has a cantilevered end that when plucked causes said tine to vibrate;

wherein said switch includes a switch lever that when operated to close actuates said switch; and wherein said actuating device is configured substantially simultaneously (a) to pluck said cantilevered end of said tine and (b) to operate said switch lever to close.

21. The automated sound producing instrument according to claim 17, wherein at least one of said first audible sound and said second audible sound is a musical note.

22. The automated sound producing instrument according to claim 17, wherein said actuating device is operable substantially simultaneously (a) to vibrate said tine and (b) to close said switch.

23. An automated musical instrument, comprising:

a plurality of tines each having an associated cantilevered end and each configured to produce a different one of a plurality of first audible sounds when its associated cantilevered end is plucked;

circuit means for producing a plurality of different second audible sounds;

a plurality of switches each comprising an associated switch lever that when operated to close actuates the associated switch, each said switch being connected to activate said circuit means to produce a different one of the plurality of said second audible sounds when said associated switch lever is operated to close;

a plurality of actuating devices each associated with one of said plurality of tines and one of said plurality of switches, and being selectably operable (a) to pluck said cantilevered end of the associated one of said tines and (b) to operate said switch lever of the associated one of said switch means to close in synchronism with plucking of said associated one of said tines, thereby to produce one of the plurality of first audible sounds and one of the plurality of second audible sounds in synchronism; and means for selectably operating said plurality of actuating devices to produce a pattern of first audible sounds and second audible sounds.

24. The automated musical instrument according to claim 23, wherein each of said actuating devices is selectably operable substantially simultaneously (a) to pluck the cantilevered end of the associated one of said tines and (b) to operate said lever of the associated one of said switch means to close.

* * * * *